US005101865A

United States Patent [19]

Okuda

[11] Patent Number: 5,101,865

[45] Date of Patent: Apr. 7, 1992

[54] DROPPER BAR SEPARATING APPARATUS

[75] Inventor: Tetsuo Okuda, Gifu, Japan

[73] Assignee: CKD Corporation, Aichi, Japan

[21] Appl. No.: 596,084

[22] Filed: Oct. 11, 1990

[30] Foreign Application Priority Data

Oct. 11, 1989 [JP] Japan ..... 1-264558

[51] Int. Cl.[5] ..... D03D 51/24

[52] U.S. Cl. ..... 139/351; 139/353

[58] Field of Search ..... 139/353, 351, 358; 28/208-210

[56] References Cited

U.S. PATENT DOCUMENTS 4,791,967 12/1988 Vandeweghe et al. ..... 139/353
4,905,737 3/1990 Gryson ..... 139/353

FOREIGN PATENT DOCUMENTS 48-38021 11/1973 Japan .
63-303152 12/1988 Japan .
1-20358 1/1989 Japan .
1467135 12/1965 United Kingdom ..... 139/351

*Primary Examiner*—Andrew M. Falik
*Attorney, Agent, or Firm*—Wenderoth, Lind & Ponack

[57] ABSTRACT

AN apparatus individually separates a plurality of dropper bars which are suspended from a dropper supporting rod. A nozzle first blows the dropper bars along the dropper supporting rod to a position at which the dropper bars are to be separated. A lifting device lifts the lower end of a forwardmost dropper bar which is to be separated from the remaining dropper bars, and advances the forwardmost dropper bar along the dropper supporting rod. A slicer than moves the lower end of the dropper bar, lifted and advanced by the lifting device, in the direction of the width of the dropper bar. A separating device receives the dropper bar from the slicer and attracts and holds the lower end of the dropper bar with a magnet. The separating device then separates the received dropper bar from the remaining dropper bars. A shutter mechanism operates in an interlocking relation with the separating device to release the upper ends of the dropper bars one by one.

9 Claims, 3 Drawing Sheets

DROPPER BAR SEPARATING APPARATUS

FIELD OF THE INVENTION

The present invention relates to an apparatus for individually separating a plurality of dropper bars, suspended from a dropper supporting rod, preparatory to weaving.

BACKGROUND OF THE INVENTION

A variety of dropper bar separating apparatuses have heretofore been developed. These conventional apparatuses may be classified into two types, that is, one in which the separation of the dropper bars is effected mechanically, and the other in which it is effected by means of a magnetic force generated by a magnet. The first type involves the problem that the structure for mechanically separating the dropper bars is complex and difficult to adjust. The second type, which includes, for example, the apparatus disclosed in Japanese Patent Publication No. 48-38021 (1973), suffers from the problem that, since this type of apparatus relies only on the attraction force generated by the magnet employed, stable separation cannot always be achieved due to adverse surface conditions of the dropper bars (e.g., irregularities in the surfaces of the dropper bars formed after repeated use, or separation of the plating from or adhesion of oil to the surfaces) and variations in the plate thickness of the dropper bars, which are made of a magnetic material.

SUMMARY OF THE INVENTION

It is an object of the present invention to provide a dropper bar separating apparatus which is capable of surely separating dropper bars regardless of their surface condition by shifting a dropper bar to be separated in the direction of the width thereof so that it is separated from the other dropper bars and then attracting it by means of a magnet.

To this end, the present invention provides an apparatus for individually separating a plurality of dropper bars which are suspended from a dropper supporting rod, comprising: lifting means for lifting the lower end of a dropper bar which is to be separated and advancing it along the dropper supporting rod; nozzle means provided adjacent to the dropper supporting rod to send the dropper bars to a position for separation by blowing air against them; slicer means for moving the lower end of the dropper bar, lifted and advanced by the lifting means, in the direction of the width of the dropper bar; separating means for attracting and holding the lower end of the dropper bar, moved by the slicer means, with a magnet and separating the dropper bar forwardly; and a shutter mechanism which operates in an interlocking relation with the separating means to release the upper ends of the dropper bars one by one.

In the above-described apparatus, the dropper bars are constantly pushed toward the position for separation by the air blown from the nozzle means. In this state, the lifting means first pushes up and advances the lower end of a dropper bar to be separated. Thereafter, the slicer means receives the lower end of the dropper bar and moves it in the direction of the width thereof. Consequently, the separating means approaches the moved dropper bar to attract and hold it by means of the magnet. Meantime, the shutter mechanism is activated in response to the operation of the separating means to release only the dropper bar which is to be separated. Thus, the forwardmost dropper bar is completely separated from the other dripper bars by the separating means.

DETAILED DESCRIPTION OF THE PREFERRED EMBODIMENTS

One embodiment of the present invention will be described below with reference to the accompanying drawings.

Figure 1:
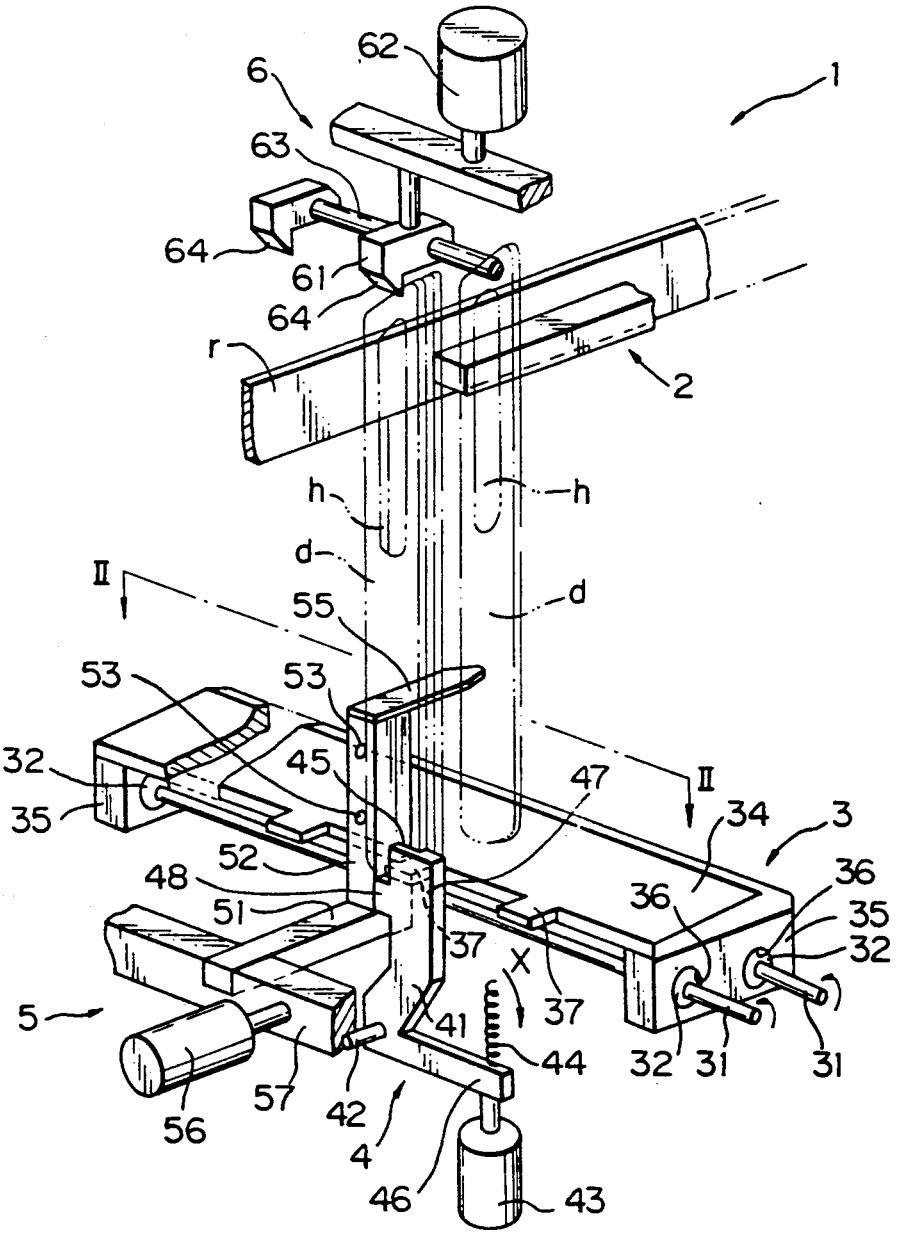
FIG. 1 is a perspective view of one embodiment of the dropper bar separating apparatus according to the present invention.
Figure 2:
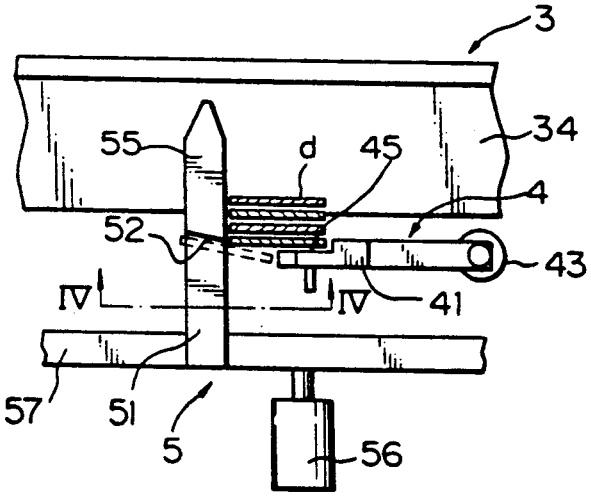
FIG. 2 is a view in direction of the line II—II in FIG. 1.

Referring to FIGS. 1 and 2, a dropper bar separating apparatus 1 of this embodiment comprises a nozzle device 2 that is provided adjacent to a dropper supporting rod r, extending through holes h in dropper bars d to support them in a suspended state wherein the dropper bars d are pivotable to a certain extent in the direction of the width thereof, a lifting mechanism 3 that is provided below the dropper supporting rod r, a moving mechanism 4 that moves the lower end of a dropper bar d in the direction of the width thereof, a separating mechanism 5 that separates and moves a dropper bar d, and a shutter mechanism 6 that is provided above the dropper supporting rod r. Although a plurality of dropper supporting rods r are suspended parallel to each other and the separating apparatus 1 is provided for separating each of the dropper supporting rods r, it should be noted that for each of explanation the separating apparatus will only be described in relation to one dropper supporting rod r.

Figure 3:
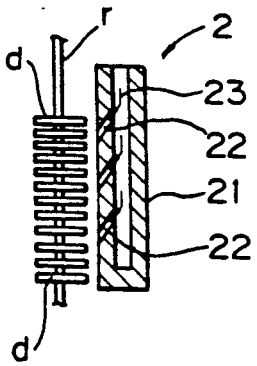
FIG. 3 is a sectional view of a nozzle that is shown in FIG. 1.

As shown in FIG. 3, the nozzle device 2 has a body 21 that is disposed adjacent and parallel to the dropper supporting rod r. The body 21 is formed with a plurality of nozzles 22 which extend obliquely forward. The nozzles 22 communicate with a supply passage 23 that is formed in the body 21 and connected to a known compressed air supply source (not shown).

The lifting mechanism 3 has a pair of parallel driving shafts 31 that extend substantially perpendicularly to the direction in which the dropper supporting rod r extends at a position below the dropper bars d suspended from the dropper supporting rod r. The driving shafts 31 are rotatably supported by bearing means (not shown), and eccentric cams 32 are attached to the driving shafts 31. The eccentric cams 32 are rotatably accommodated in respective bores 36 provided in leg portions 35 of a lifting member or a lifting plate 34, which is provided above and along the driving shafts 31. The eccentric cams 32 have a known structure. That is, each eccentric cam 32 has a circular outer periphery, and the associated driving shaft 31 is eccentrically attached thereto. A projection 37 is formed on the forward (left side as viewed in FIG. 1) edge of the lifting plate 34 at a position which is directly below each row of dropper bars d. Accordingly, there are provided a number of projections 37.

The response to the rotation of the driving shafts 31 in the direction of the arrows, the lifting plate 34 rises and then moves forward, thereby lifting and moving forward dropper bars d which are resting on the lifting plate 34.

The moving mechanism 4 has a substantially L-shaped lever or a slicer 41, which is pivotably supported through a pivot shaft 42 at a position which is below and forward of the row of dropper bars d, a cylinder 43 that pushes one end 46 of the lever 41, and a spring 44 that constantly biases the slicer 41 clockwise as viewed in FIG. 1 (in the direction of the arrow X). The upper corner portion at the other end 47 of the slicer 41 is formed with a notch 45 having a depth which is substantially equal to or slightly smaller than the thickness of one dropper bar d. The second end 47 of the slicer 41 is also provided with a projection 48.

Figure 4:
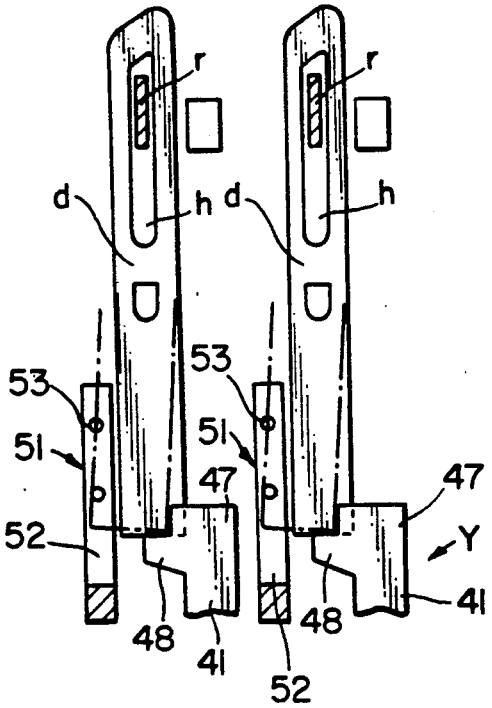
FIG. 4 is a view in direction of the line IV—IV in FIG. 2.

The moving mechanism 4 stands by at a position which is forwardly of the foremost dropper bar d with the second end 47 of the slicer 41 being held upright. When the dropper bars d are advanced by the lifting mechanism 3, the corner portion at the lower end of the foremost dropper bar d enters the notch 45 in the slicer 41 and in this state the dropper bar d stops. Thereafter, the cylinder 43 is activated to pivot the slicer 41 in the direction of the arrow Y, as shown in FIG. 4, thereby causing the lower end of the dropper bar d received in the notch 45 to move in the direction of the width thereof, as shown by the chain line in the figure.

The separating mechanism 5 has a separating member or a shifter 51, which is disposed below the row of dropper bars d (at the side where a dropper bar d is pushed by the moving mechanism 4). The shifter 52 has a vertical surface 52 which comes into contact with the surface of a dropper bar d, the vertical surface 52 having permanent magnets 53 embedded therein. A guide plate 55 is attached to the top of the shifter 51 to align the dropper bars d that are suspended from the dropper supporting rod r. The shifter 51 is secured to a bar 57 that extends substantially parallel to the driving shafts 31. The bar 37 is reciprocated in a direction parallel to the dropper supporting rod r by the operation of a cylinder 56. Thus, the shifter 51 is moved along the dropper supporting rod r by the cylinder 56 through the bar 57.

Although in FIG. 1 only one lever 41 and one shifter 51 are shown, it should be noted that, when a plurality of dropper supporting rods r are disposed in parallel, levers 41 and shifters 51 are provided in a number which corresponds to the number of dropper supporting rods r.

The shutter mechanism 6 has a pawl 61 that engages at the distal end 64 with the upper end of a dropper bar d to stop the movement thereof, and a cylinder 62 that lifts and lower the pawl 61. The cylinder 62 operates synchronously with the cylinder 56 of the separating mechanism 5. More specifically, when the foremost dropper bar d is separated forwardly by the shifter 51, the cylinder 62 lifts the pawl 61 to allow the separation of the dropper bar d.

The lifting plate 34 extends substantially perpendicularly in the direction in which the dropper supporting rod r extends and the shifter 51 is attached to the rod 57 that extends parallel to the lifting plate 34. In addition, the pawl 61 of the shutter mechanism 6 is attached to a rod 63 that extends above the dropper supporting rod r at substantially right angles thereto. A plurality of dropper supporting rods are disposed in parallel to each other and to provide a shifter, pawl, etc. for each of the rods.

In the foregoing arrangement, the dropper bars d that are suspended from the dropper supporting rod r are successively sent to the position for separation by means of the air that is blown from the nozzles 22. When the driving shafts 31 of the lifting mechanism 3 rotate and the lifting plate 34 rises and moves forward under the action of the eccentric cams 32, the dropper bars d are lifted and shifted forward by the projection 37. Consequently, the lower corner portion of the foremost dropper bar d enters the notch 45 in the slicer 41 of the moving mechanism 4. Thereafter, the slicer 4 is pivoted in the direction of the arrow Y (see FIG. 4) to move the lower end of the dropper bar d in the direction of the width thereof. This is possible because the thickness of the dropper supporting rod r is small in comparison to the width of the hole h in the dropper bar d). Thus, the forwardmost dropper bar d is projected sidewardly from the other dropper bars d, as shown by the chain line in FIG. 4. Subsequently, the dropper bar d is magnetically held by the shifter 51 of the separating mechanism 5 as viewed in FIG. 2, and is then separated. At this time, the pawl 61 of the shutter mechanism 6 moves upward.

According to the present invention, dropper bars are mechanically moved one by one with the slicer before being separating with the shifter. Accordingly, even if the surface condition of the dropper bars has deteriorated or has been contaminated with oil, paste or the like, the dropper bars can still be surely separated. In addition, since the separation is independently carried out for each row of dropper bars, a row of dropper bars can be selectively separated as desired.

Although the best mode contemplated by the inventor for carrying out the present invention has been shown and described herein, it will be apparent to those skilled in the art that suitable modifications, variations, and equivalents may be made without departing from the scope of the invention, such scope being limited solely by the terms of the following claims.

What is claimed is:

1. An apparatus for individually separating a plurality of dropper bars which are suspended from a dropper supporting rod, said apparatus comprising:

lifting means for lifting the lower end of a forwardmost dropper bar which is to be separated and advancing it along the dropper supporting rod;

nozzle means provided adjacent to the dropper supporting rod for blowing a supply of air against the dropper bars to move the dropper bars to a position facilitating their separation;

slicer means for moving the lower end of the dropper bar, lifted and advanced by said lifting means, in the direction of the width of the dropper bar;

separating means, including a shifter having a magnet, for attracting and holding the lower end of the dropper bar, moved by said slicer means, and separating the held and attracted dropper bar in a forward direction from the remaining dropper bars; and a shutter mechanism, in an interlocking operative relation with said separating means, for releasing the upper ends of said dropper bars one by one.

2. A dropper bar separating apparatus according to claim 1, in which there are a plurality of parallel dropper supporting rods, and wherein respective said slicer means and shifters of said separating means are associated with each of the dropper rods and are disposed in parallel.

3. A dropper bar separating apparatus according to claim 1 or 2, wherein said lifting means comprises eccentric cams, a pair of parallel driving shafts attached to said cams, and a lifting member supported by said cams in a manner in which said lifting member is caused to move up and down as well as back and forth by said eccentric cams.

4. A dropper bar separating apparatus according to claim 3, wherein said separating means has a bar that is disposed substantially parallel to said lifting means, each said shifter secured to said bar.

5. A dropper bar separating apparatus according to claim 5, wherein each said shifter defines a vertically extending surface, a said magnet being attached to said surface.

6. A dropper bar separating apparatus according to claim 3, wherein each said shifter has a notch therein for receiving the lower end of the forwardmost dropper bar.

7. A dropper bar separating apparatus according to claim 1 or 2, wherein said separating means has a bar that is disposed substantially parallel to said lifting means, each said shifter secured to said bar.

8. A dropper bar separating apparatus according to claim 7, wherein each said shifter defines a vertically extending surface, a said magnet being attached to said surface.

9. A dropper bar separating apparatus according to claim 1 or 2, wherein each said shifter has a notch therein for receiving the lower end of the forwardmost dropper bar.

* * * * *